US007611202B2

(12) United States Patent
Johnson et al.

(10) Patent No.: US 7,611,202 B2
(45) Date of Patent: Nov. 3, 2009

(54) TILT MECHANISM FOR A CHAIR

(75) Inventors: Leroy B. Johnson, Lowell, MI (US); Philip Crossman, Suttons Bay, MI (US)

(73) Assignee: L & P Property Management Company, South Gate, CA (US)

( * ) Notice: Subject to any disclaimer, the term of this patent is extended or adjusted under 35 U.S.C. 154(b) by 7 days.

(21) Appl. No.: 11/954,752

(22) Filed: Dec. 12, 2007

(65) Prior Publication Data

US 2009/0152921 A1 Jun. 18, 2009

(51) Int. Cl.
*A47C 1/032* (2006.01)

(52) U.S. Cl. ..... 297/343

(58) Field of Classification Search ..... 297/318, 297/343, 341, 342, 317, 316
See application file for complete search history.

(56) References Cited

U.S. PATENT DOCUMENTS 1,414,637 A * 5/1922 Gell ..... 297/343
2,143,098 A * 1/1939 Wohlk ..... 297/343
2,182,598 A * 12/1939 Owler ..... 297/343
5,660,439 A * 8/1997 Unwalla ..... 297/316
5,735,574 A * 4/1998 Serber ..... 297/284.4
6,641,214 B2 * 11/2003 Veneruso ..... 297/322
6,685,267 B1 2/2004 Johnson et al.

FOREIGN PATENT DOCUMENTS

GB 2429405 A1 2/2007

* cited by examiner

*Primary Examiner*—Milton Nelson, Jr.
(74) *Attorney, Agent, or Firm*—Shook, Hardy & Bacon L.L.P.

(57) ABSTRACT

A tilt mechanism provides improved coordination in the motions of a chair seat and a chair back during chair tilt. In one aspect, the tilt mechanism includes a seat base, a back bracket, a back support bar, a guide track and a back follower member. The seat base is slidably coupled to the chassis and rigidly coupled to the chair seat. The back support bar is configured for moveable engagement with the back bracket coupled with the chair back. Additionally, the back follower member, coupled with the chair back, is received within one or more channels formed in the guide track for moveable engagement therewith. A proportional and asynchronous action is achieved via the back bracket moving relative to and in engagement with the back support bar, the back follower member moving within the guide track and the seat base sliding forwardly relative to the chassis.

13 Claims, 7 Drawing Sheets

TILT MECHANISM FOR A CHAIR

BACKGROUND OF THE INVENTION

Office-type chairs are commonly utilized in modern working environments to provide an occupant with a level of comfort while performing certain tasks that require a person to be in a seated position for an extended length of time. One common configuration for such a chair includes a mobile base assembly (to allow the chair to roll across a floor) and a pedestal column supporting the superstructure of the chair. A chassis is also provided to enable the user to adjust certain settings of the chair and to facilitate recline or "tilt" of the chair superstructure, including the seat and back of the chair. This basic chair configuration allows the user to change their sitting position in the chair as desired, such that fatigue is minimized during long sitting periods.

In recent years, chair designs have implemented a feature where a chair back and seat both move simultaneously during a tilting or rearwardly reclining motion, with the back generally tilting to a greater degree than the seat. The combined movement of the chair back and seat in these designs results in some level of improvement for the occupant through a range of tilting motions over a conventional "static" chair without back and seat movement. Still, even with the benefits provided by known combined movement chairs, a chair design that minimizes user strain and works in coordination with the pivoting of a person's body about their natural hip pivot point during tilting activities has proven elusive.

BRIEF SUMMARY OF THE INVENTION

This Summary is provided to introduce a selection of concepts in a simplified form that are further described below in the Detailed Description.

Accordingly, embodiments of the present invention provide a tilt mechanism for a chair employing proportional and asynchronous movement schemes. The tilt mechanism is particularly well suited for implementation on a chair having a base assembly and upwardly extending pedestal, where the mechanism interconnects the chair seat and the chair back. In embodiments, the coordinated movement of the chair seat and chair back arranged by the tilt mechanism is in a proportional relationship. Further, the geometry of the tilt mechanism directs the chair seat and chair back movement during a recline motion in such a way that a virtual pivot point is formed.

In one aspect, an embodiment of a tilt mechanism for a chair includes a seat base, a back bracket, a back support bar, a guide track and a back follower member. The seat base is slidably coupled to the chassis and rigidly coupled to the chair seat. The back support bar has a body portion extending from the chassis and a distal end configured for moveable engagement with the back bracket coupled with the chair back. Additionally, the back follower member couples with and depends from the chair back and is received within one or more channels formed in the guide track for moveable engagement therewith. An asynchronous tilt action is achieved via the back bracket moving relative to and in engagement with the back support bar distal end, the back follower member moving within the one or more channels of the guide track and the seat base sliding forwardly and upwardly relative to the chassis, all of which occurs when the chair occupant moves the chair from an upright position to a recline position.

Another implementation of a tilt mechanism for a chair is provided in a further aspect. The tilt mechanism includes a chassis, a seat base, one or more slotted guide tracks disposed with the seat base, one or more back follower members, a back bracket and a back support bar. The chassis couples with the pedestal of the chair on which the tilt mechanism is located. The seat base is slidably coupled to the chassis and rigidly coupled to the chair seat. Each back follower member couples with and depends from the chair back, and is received within one of the slotted guide tracks for moveable engagement therewith. The back support bar has a body portion extending from the chassis and a distal end configured for moveable engagement with the back bracket coupled with the chair back. An asynchronous tilt action is achieved via the back bracket moving relative to and in engagement with the back support bar distal end, each back follower member moving generally forwardly within one of the slotted guide tracks and the seat base sliding forwardly and upwardly relative to the chassis, all of which occurs when the chair occupant moves the chair from an upright position to a recline position.

Such proportional and asynchronous movement schemes provide many benefits to the chair occupant moving between an upright position and a reclined position. Examples of these benefits include proper support for the user's back, reduced "shirt shear", or the upward and downward pull on a user's shirt by the chair back, minimal movement of the user's center of gravity relative to the pedestal or other substructure of the chair (to maintain good stability in the chair), minimal change to the user's sight or reach distance from a working surface (e.g., a computer display screen), among other benefits. The tilt mechanism, in embodiments, also facilitates the chair (and seat) being generally self-weighting, such that a traditional tensioning mechanism affecting chair backward tilting is essentially unnecessary.

Additional advantages and novel features of the invention will be set forth in part in a description which follows and, in part, will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
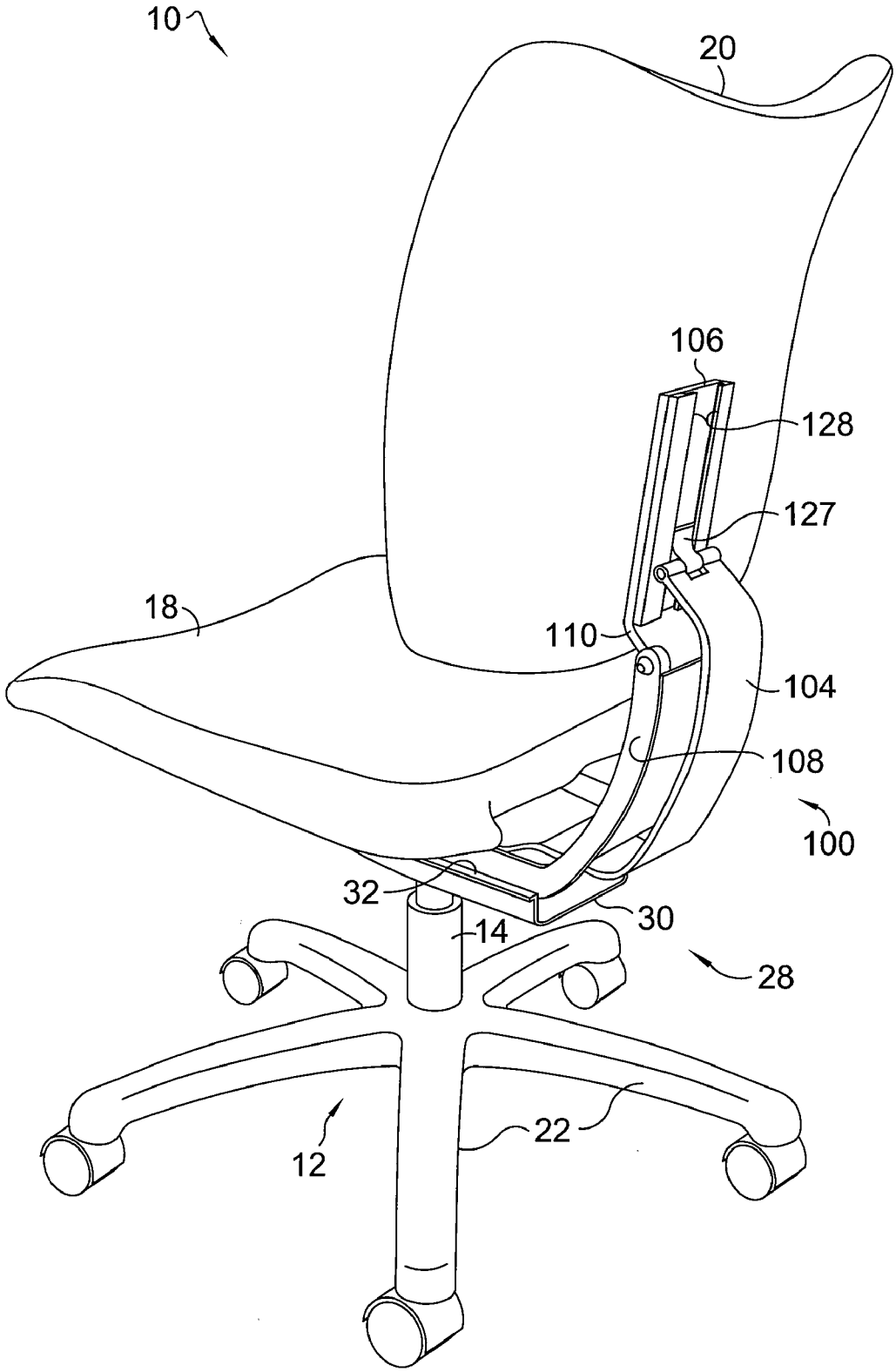
FIG. 1 is a back perspective view of a chair and a tilt mechanism integrated therewith, in accordance with one embodiment of the present invention.
Figure 4:
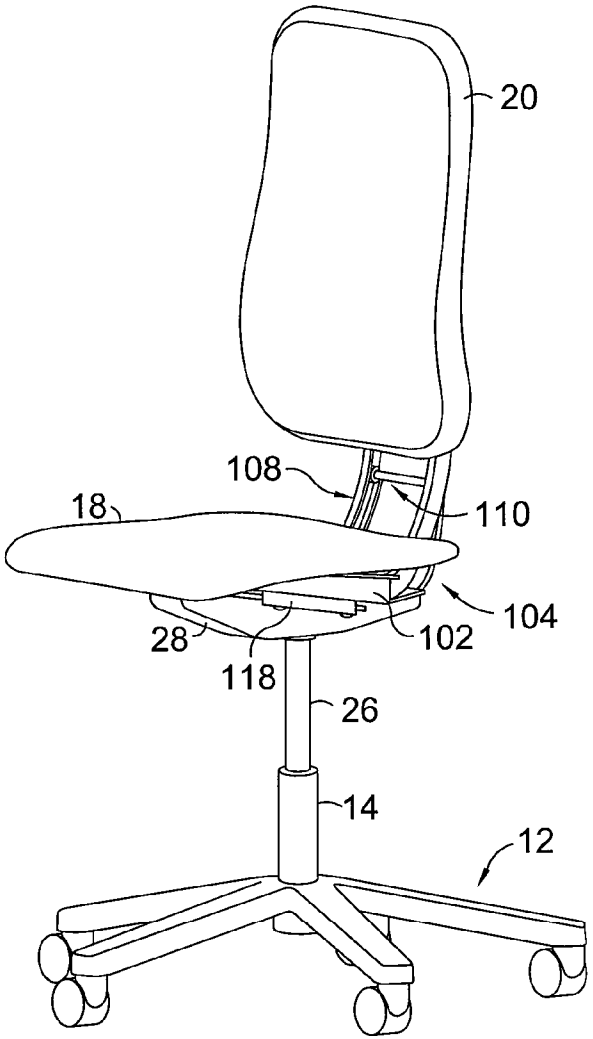
FIG. 4 is a front perspective view of the chair and tilt mechanism of FIG. 1.
Figure 2:
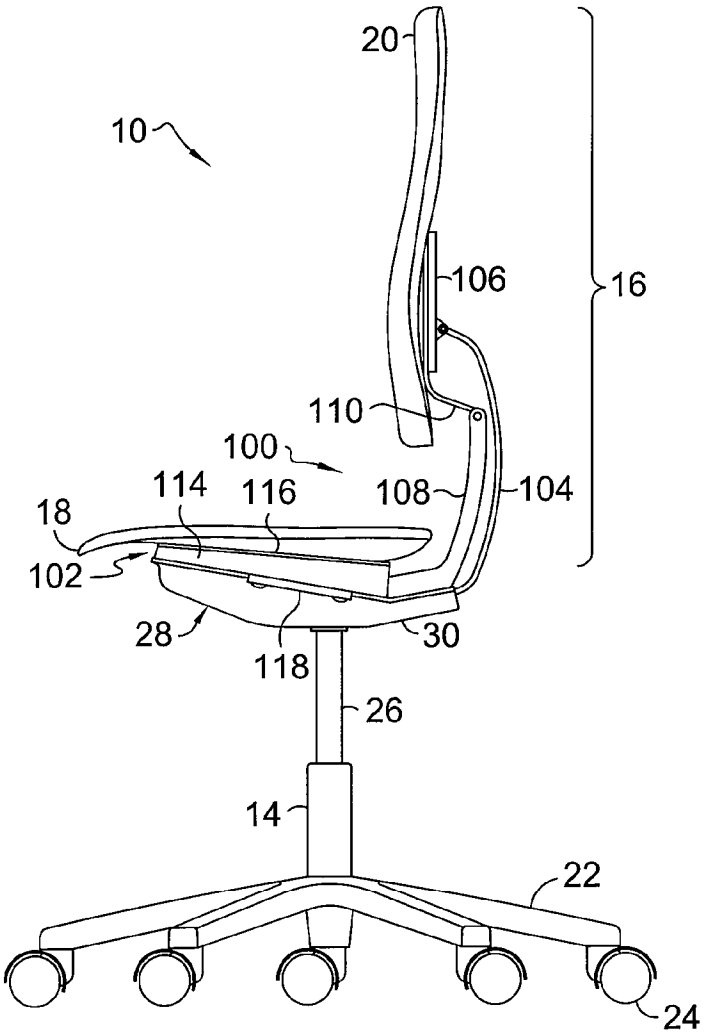
FIG. 2 is a side elevational view of the chair and tilt mechanism of FIG. 1.

Referring to the drawings in greater detail and initially to FIGS. 1 and 2, an exemplary chair employing a tilt mechanism of the present invention is designated generally by the numeral 10. As is known in the art, a conventional office-type chair has a base assembly 12 with a pedestal column 14 extending upwardly therefrom to support a superstructure 16 of the chair 10. The chair superstructure 16 includes, among other things, a chair seat 18, a chair back 20, and components to interconnect the seat 18 with the back 20 (i.e., a tilt mechanism). The base assembly 12 includes a number of support legs 22 extending radially from the column 14 and a corresponding number of castors 24 operably supported on the outer ends of the support legs 22. Additionally, a gas cylinder 26 or other lifting mechanism is preferably supported by the column 14 to enable the height of the seat 18 (and thus the chair superstructure 16) to be adjusted by an occupant.

It should be understood that various embodiments of a tilt mechanism of the present invention are shown throughout the figures employed in the design of an office-type chair, such as chair 10. Each tilt mechanism functions to couple together a chair seat with a chair back to facilitate a proportional and asynchronous tilting motion during shifting of the chair 10 between an upright position and a reclined (backwardly tilted) position, and vice versa. Generally, when a chair occupant instigates a recline motion by "leaning back" in the chair 10, the various embodiments of the tilt mechanism guide the chair back in a somewhat downward motion with an increasing rearward tilt angle while the chair seat correspondingly moves forwardly and ramps upwardly as it travels over the chassis. This movement pattern, with a proportional relationship between the degree of movement of the chair seat and back guided by the tilt mechanism, provides the chair occupant with a comfortable and supportive "ride" through a range of positions. Additionally, the tilt mechanism provides for a more open body angle between the occupant's torso and lower body during recline, which reduces fatigue while sitting in the chair. The substructure of the chair 10 (i.e., the base assembly 12, column 14 and generally, a chassis 28 mounted onto the top end of the gas cylinder 26) generally remains stationary during the tilting motion. Additionally, it should be understood that the chassis 28 may provide the functionality of a typical office chair chassis, including housing and connecting with features such as a tilt limiter and chair height adjuster (via engaging the gas cylinder 26). The construction of these components is well known in the art and is not described further herein for sake of clarity.

With particular reference to FIGS. 1-6, one embodiment of a tilt mechanism 100 is depicted. The mechanism 100 includes, broadly, a seat base 102 operatively supporting the chair seat 18, a back support bar 104 and a back bracket 106 interconnecting the chassis 28 with the chair back 20, as well as a guide track 108 and a back follower member 110 working in tandem to tie movement of the chair back 20 with the seat base 102 and thus the chair seat 18. The seat base 102 is slidingly coupled to the chassis 28 such that the base 102 sits atop and is supported by the chassis 28. The top end of the gas cylinder 26 extends through a central hole in a bottom side of the chassis 28 and is secured thereto, such that as the cylinder 26 extends and retracts to adjust the height of the chair superstructure 16, the chassis 28 correspondingly moves up and down. As one example, a tapered bushing can be utilized to achieve the connection between the cylinder 26 and the chassis 28, as is known to those of skill in the art. It should be understood that the terms "forward", "rearward" and "lateral", as used herein, each have a particular meaning that is defined in relation to a flat support surface beneath the chair 10 (e.g., parallel to a floor on which castors 24 rest) and in relation to an occupant of the chair. For instance, the term "forward" refers to a direction moving away from the back support bar 104 and in front of a chair occupant along an axis in parallel-spaced relation to such a flat support surface, while the term "rearward" refers to a direction moving towards the back support bar 104 and behind a chair occupant directly opposite of the forward direction. The term "lateral" refers to a generally horizontal direction perpendicular to both the forward and rearward direction and in parallel-spaced relation to the aforementioned flat support surface.

In an embodiment, the chassis 28 is formed as a stamped or cast metal piece including a generally U-shaped body 30 and a pair of opposed, outwardly extending flanges 32. Alternatively, the chassis 28 may be formed of molded plastics, composites, or other materials capable of providing a rigid and sturdy support structure for other components of the chair 10, as well as the chair occupant. Over an extended length of the flanges 32, the upper surfaces thereof form a plane that inclines at a relatively small upwardly oriented angle moving forwardly towards a front side of the chair 10. This plane determines the direction of travel of the seat base 102 and thus the seat 18, as explained in more detail herein. As one example, the plane formed by the flange 32 upper surfaces may present an incline of between 10 and 11 degrees relative to a flat surface on which the chair 10 is positioned, such that the seat base 102 "ramps" up at such an incline when moving forwardly on the chassis 28. Through the forward and upward movement of the seat base 102, the chair 10 (along with the proportional tilting of the chair back 20) becomes self-weighing, providing, in a sense, a counterbalancing force generally proportional to the chair occupant's weight. This feature can reduce or eliminate the need for a traditional tension adjustment for the chair 10.

Figure 3:
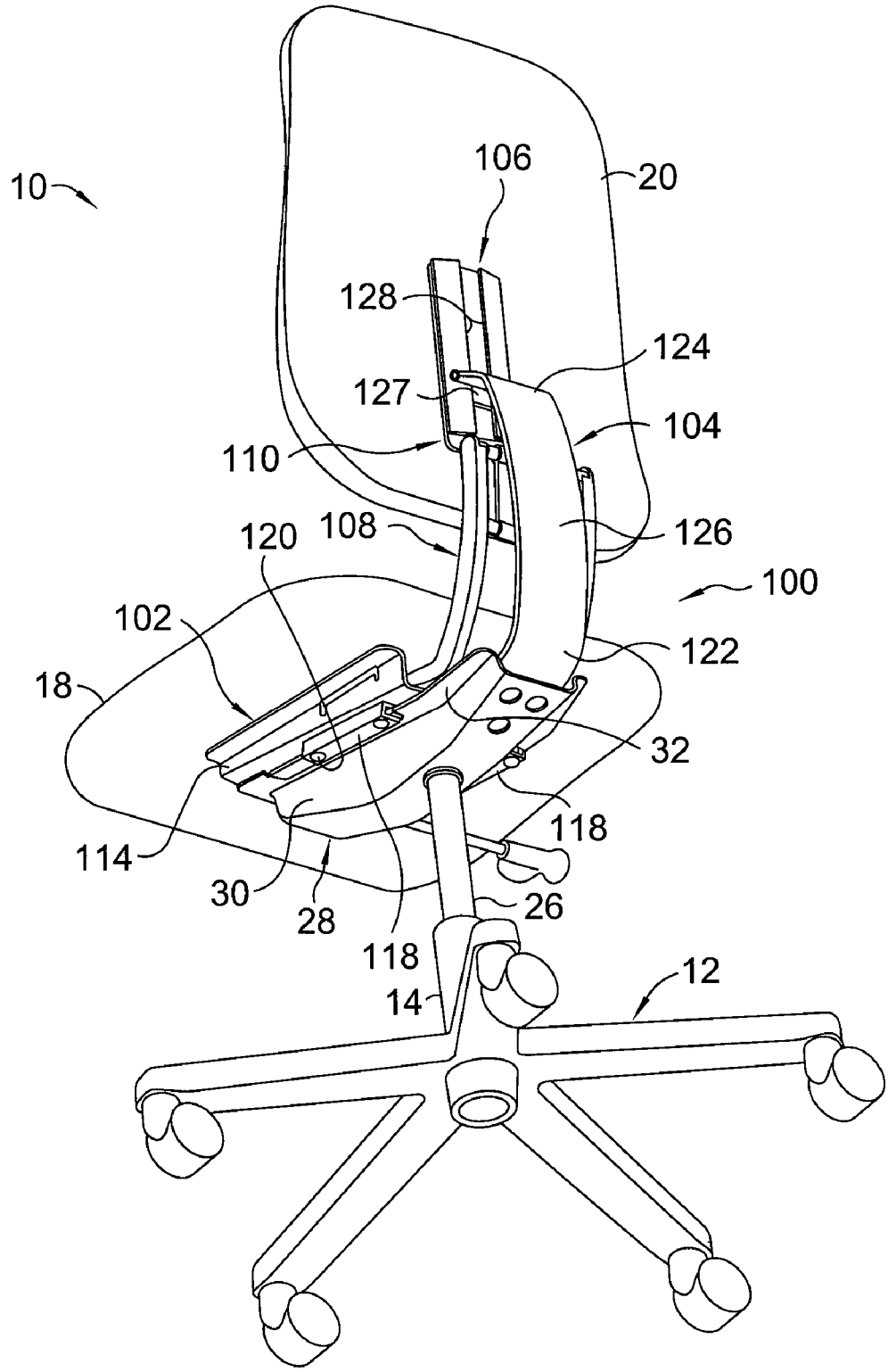
FIG. 3 is an underside perspective view of the chair and a tilt mechanism of FIG. 1.

Similarly, the seat base 102 may be formed as a stamped or cast metal piece with a U-shaped body 114 and opposed, outwardly extending flanges 116 (or alternatively may be formed of molded plastics, composites, or other materials as with the chassis 28). The seat base flanges 116, as seen in FIGS. 2 and 3, provide a mounting surface for the seat 18. The seat base body 114 generally has a lateral width greater than the chassis body 30, such that the body 114 at least partially overlies the chassis flanges 32. This allows a pair of coupling sliders 118 to be mounted onto the seat base body 114 via fasteners 120 for traveling along the length of the chassis flanges 32. The coupling sliders 118 are generally C-shaped in longitudinal cross-section for receiving therein the chassis flanges 32, such that the seat base 102 is guided in sliding movement forwardly and rearwardly along the flanges 32.

Figure 5:
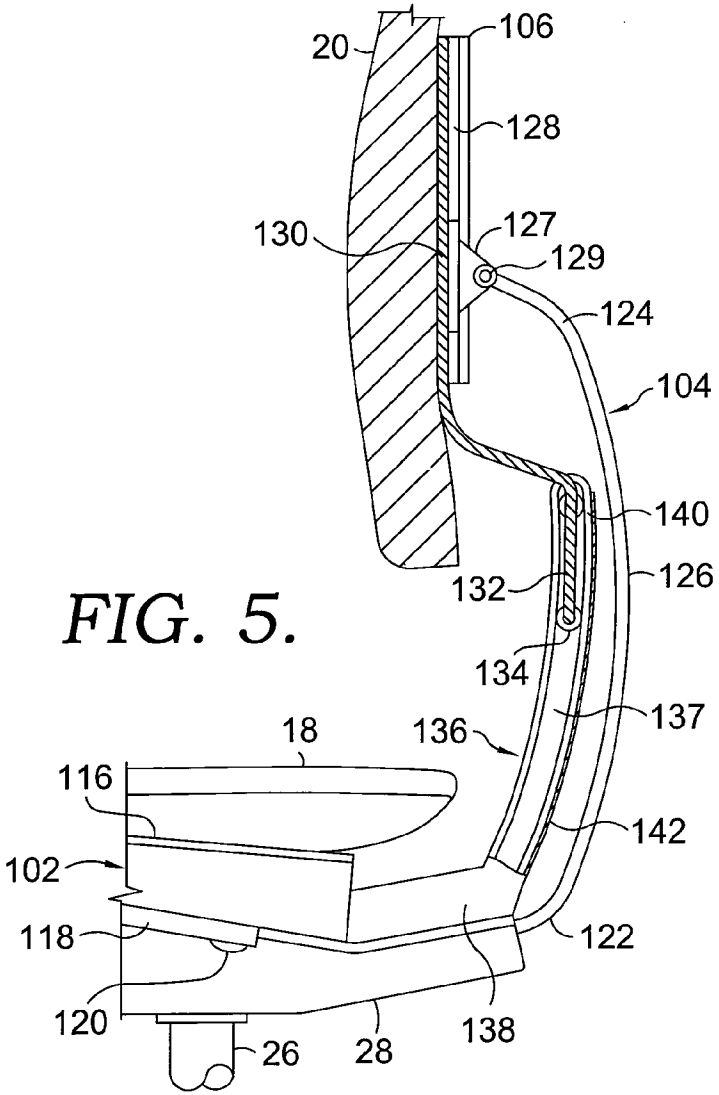
FIG. 5 is an enlarged side elevational view of the tilt mechanism of FIG. 1, partially in section, showing the position of the mechanism components when the chair is in an upright position.
Figure 6:
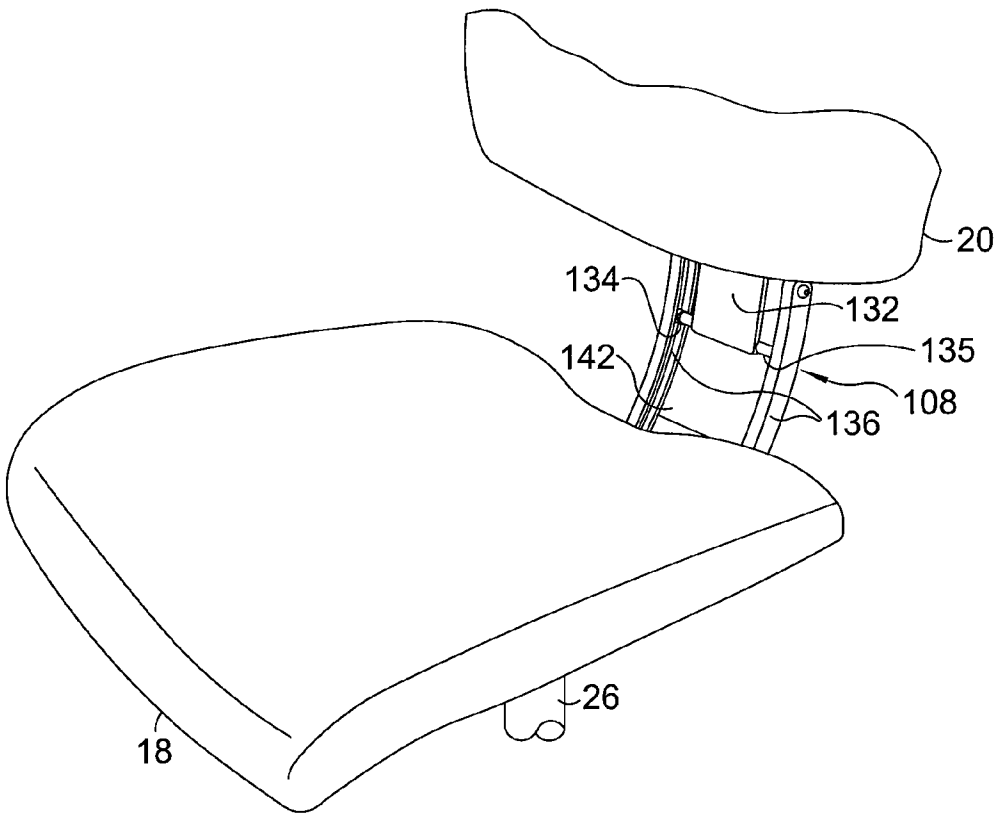
FIG. 6 is an enlarged front perspective view of the tilt mechanism of FIG. 1, showing the guide track and back follower member.

With continued reference to FIGS. 1-6, the back support bar 104 has a proximal end 122 rigidly connected with the chassis body 30 (e.g., by welding or securing with fasteners), a distal end 124, and a body portion 126 spanning between the two ends 122 and 124. The distal end 124 of the back support bar 104 includes a slider 127 pivotably connected to the body portion 126 via a pin 129. The back bracket 106 has a generally C-shaped cross-section to form a pair of opposed, elongate linear slots 128 in which the slider 127 is received. The back bracket 106 itself may be rigidly attached directly to the chair back 20 (e.g., by fasteners) or, preferably, is attached to the back follower member 110. In either case, the back bracket 106 is thus coupled to the chair back 20, whether directly or indirectly through the back follower member 110. The back follower member 110 has a generally planar upper portion 130 to abut and rigidly attach to the chair back 20 and a lower portion 132 configured for moveable engagement with the guide track 108. As best seen in FIGS. 3 and 5, the back follower member lower portion 132 has two sets of laterally positioned, axially mounted rollers 134 interconnected therewith via pins 135 rigidly connected with the lower member portion 132. The rollers 134 travel within a pair of opposed channel forming members 136 of the guide track 108 when the chair back 20 is in motion between a reclined position and a upright position. Each channel forming member 136 establishes a continuous, elongate travel channel 137 therein. By enabling (a) the lower portion 132 of the back follower member 110 to move relative to the guide track 108, and (b) the slider 127 and pivotably connected back support bar 104 to move relative to the back bracket 106, the chair back 20 is allowed to move relative to both the chassis 28 (which is generally stationary during a reclining motion) and the seat base 102 interconnected with the guide track 108. It should be understood that components forming the back bracket 106 and guide track 108 may be formed from metals, plastics, or other composites.

Each channel forming member 136 of the guide track 108 has a lower portion 138 and an upper portion 140. The lower portion 138 is configured for rigid connection with the seat base 102 (e.g., by welding or securing with fasteners), and the upper portion 140 extends generally upwardly and rearwardly away from the seat base 102. The upper portion 140 provides the travel channel 137 or pathway for the back follower member lower portion 132 and associated rollers 134. Preferably, the travel channels 137 trace a curvilinear pathway with a center point of a radius of the pathway serving as a virtual pivot point generally forwardly of the chair seat 18 and the chair back 20. The virtual pivot point represents a theoretical location where a hip pivot point would be located for chair occupants of a range of sizes. In this way, the geometry of the guide trade encourages a more natural opening up of the chair occupants body (between their torso and legs) during a recline motion. A thin plate 142 may also be provided to laterally interconnect the structure of the guide track 108 into which the pair of elongate channels 136 are formed. It should be understood that the combined plate 142 and guide track 108 may also be formed from a one piece molded plastic or composite.

Figure 8:
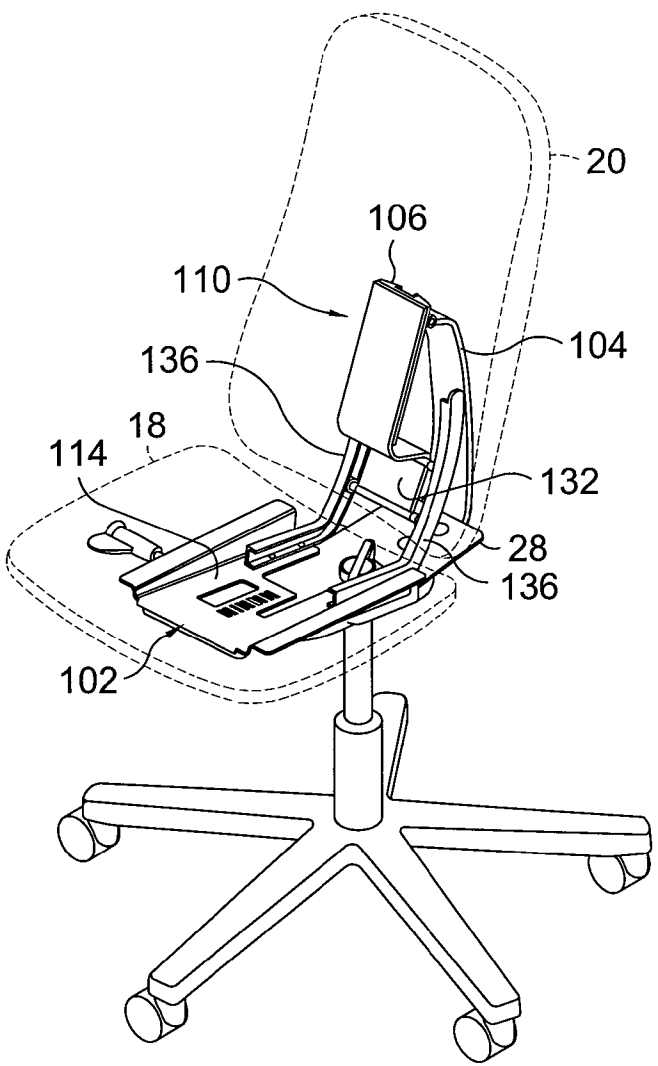
FIG. 8 is a view similar to FIG. 7, but with the chair in the reclined position.
Figure 7:
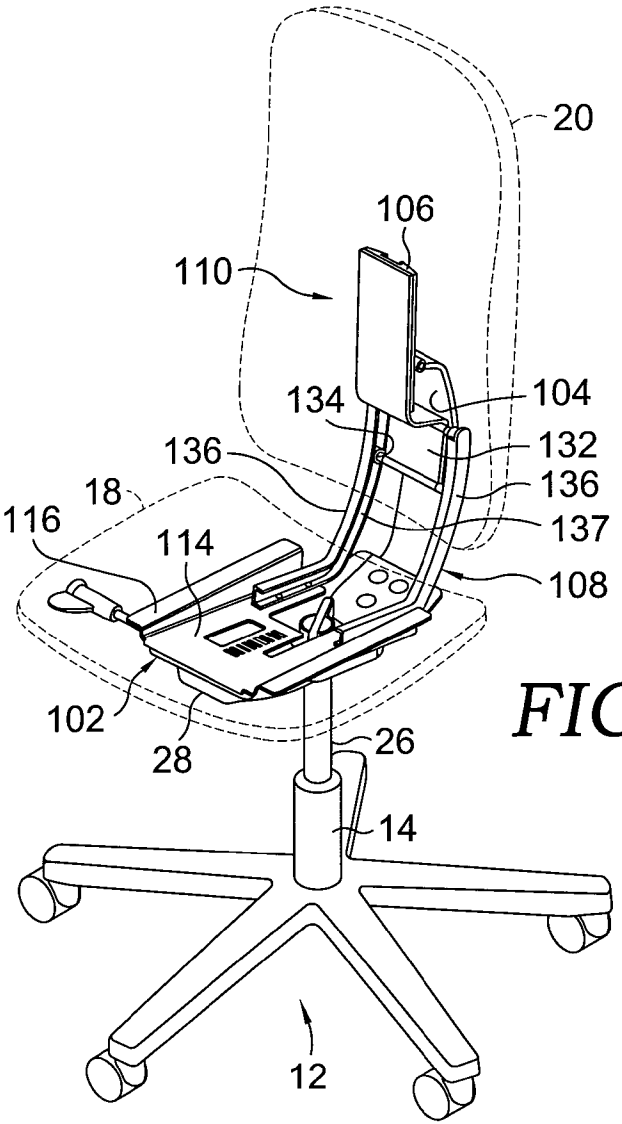
FIG. 7 is a front perspective view of the chair and tilt mechanism of FIG. 1, with the seat and back removed, showing the position of the mechanism components when the chair is in an upright position.

With additional reference to FIGS. 7 and 8, upon the chair occupant leaning backward to induce reclining of the chair back 20 (the "recline phase"), the rollers 134 of the back follower member 110 move along the length of the guide track upper portions 140 and direct the back follower member lower portion 132 generally downwardly in the direction of the guide track lower portion 138 and chair chassis 28, as seen in FIG. 8. Concomitant with this action, the leaning backward by the occupant also causes the back support bar 104 to flex and move rearwardly about the proximal end 122 thereof, while the linear slots 128 of the back bracket 106 guide the generally downward movement of chair back 20 through the sliding connection with the slider 127 and the pinned connection of the slider 127 with the back support bar 104.

Furthermore, the shifting of the occupant's upper body during the recline phase and the generally forwardly directed bias provided by the backward flexing of the back support bar 104 cause a reactive force against the user's lower body positioned on the seat 18. The reactive force drives the forward sliding movement of the seat base 102 (and thus the seat 18) on the chassis 28 in asynchronous fashion and proportional to the backward tilting of the seat back 20. Specifically, the coupling sliders 118 move linearly forwardly along the chassis flanges 32 to facilitate the seat base 102 movement. Thus, the reactive force driving the forward (and upward) sliding movement of the seat base 102 leads to the self-weighing characteristic for the chair 10.

Upon the chair occupant leaning forward (the "return phase") the tilt mechanism 100 reverses these actions to bring the chair 10 back to the upright, unloaded position depicted in FIG. 7. Specifically, the back support bar 104 returns to an unflexed position and the slider 127 moves downwardly within the back bracket slots 128 to return to the original position. The back follower member lower portion 132 also moves generally upwardly in a direction away from the guide track lower portion 138 and chair chassis 28. Due to the configuration of the tilt mechanism 100, the seat 18 and seat base 102 also slide rearwardly on the chassis 28 together to the original position during the return phase.

Figure 9:
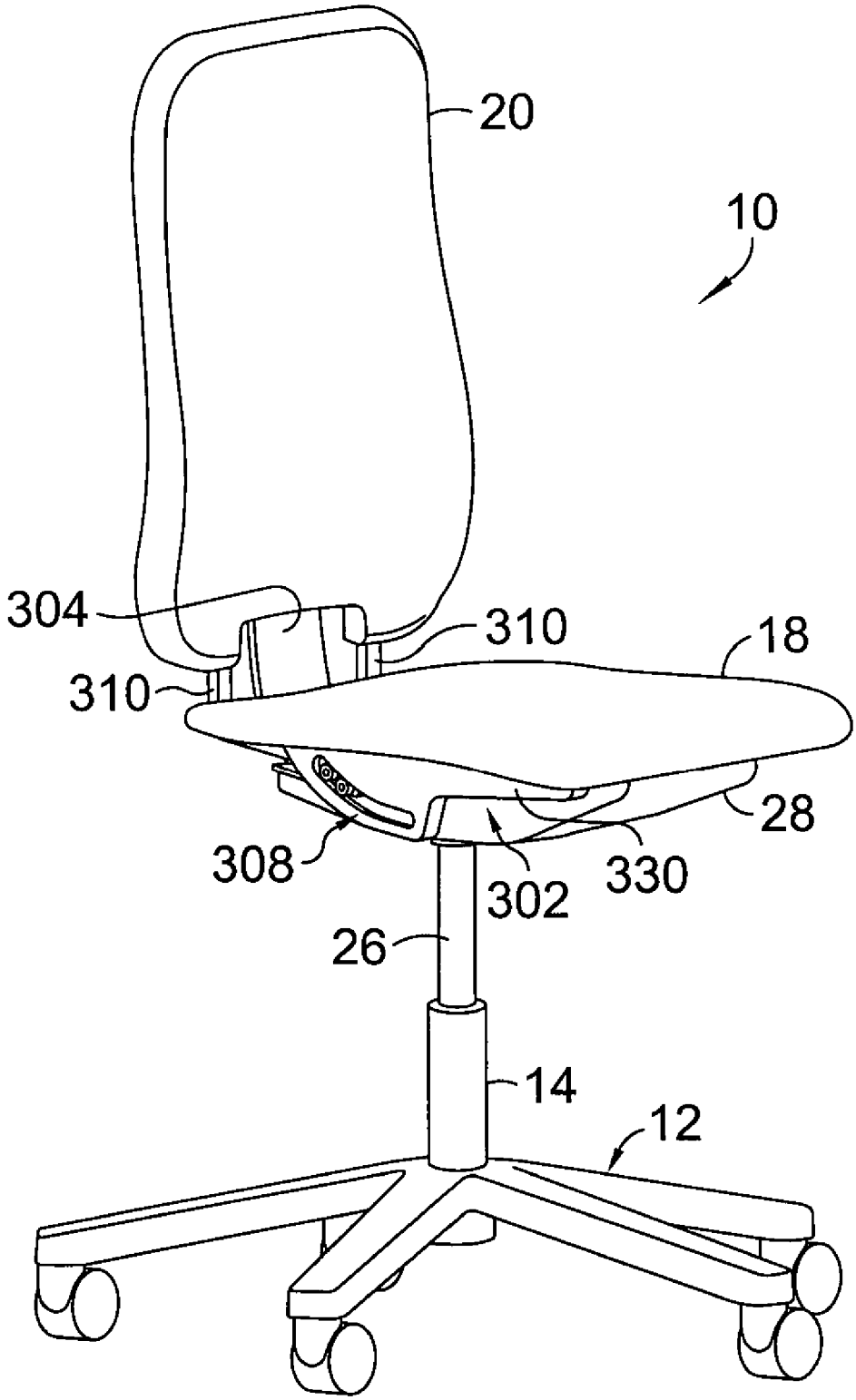
FIG. 9 is a front perspective view of another embodiment of a chair and a tilt mechanism integrated therewith.
Figure 11:
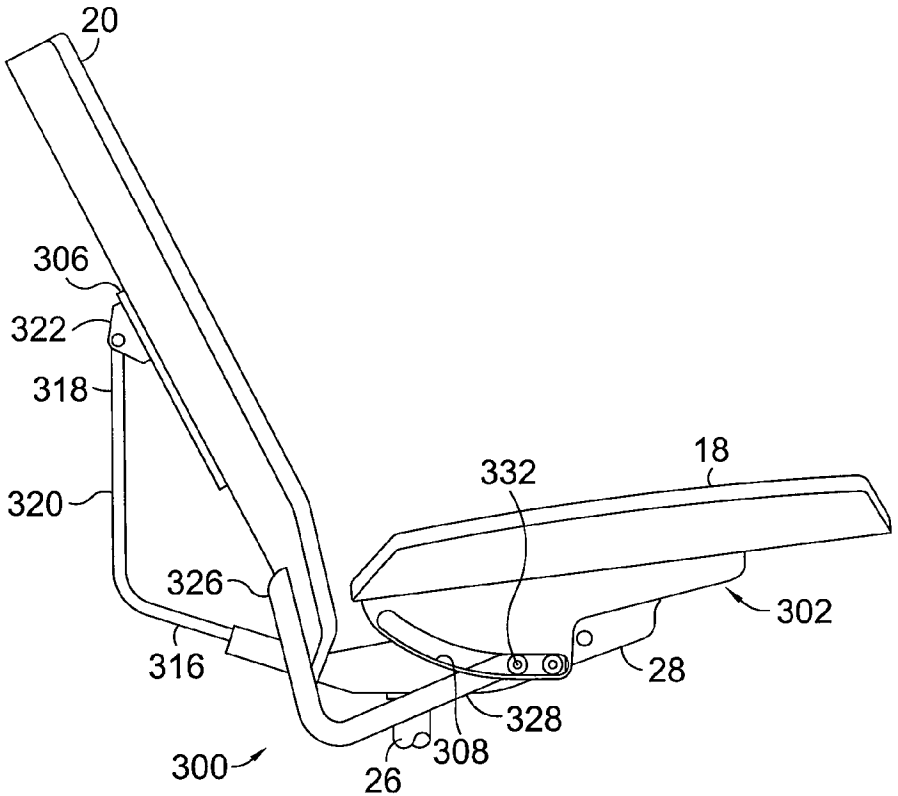
FIG. 11 is a view similar to FIG. 10, but with the chair in the reclined position.
Figure 10:
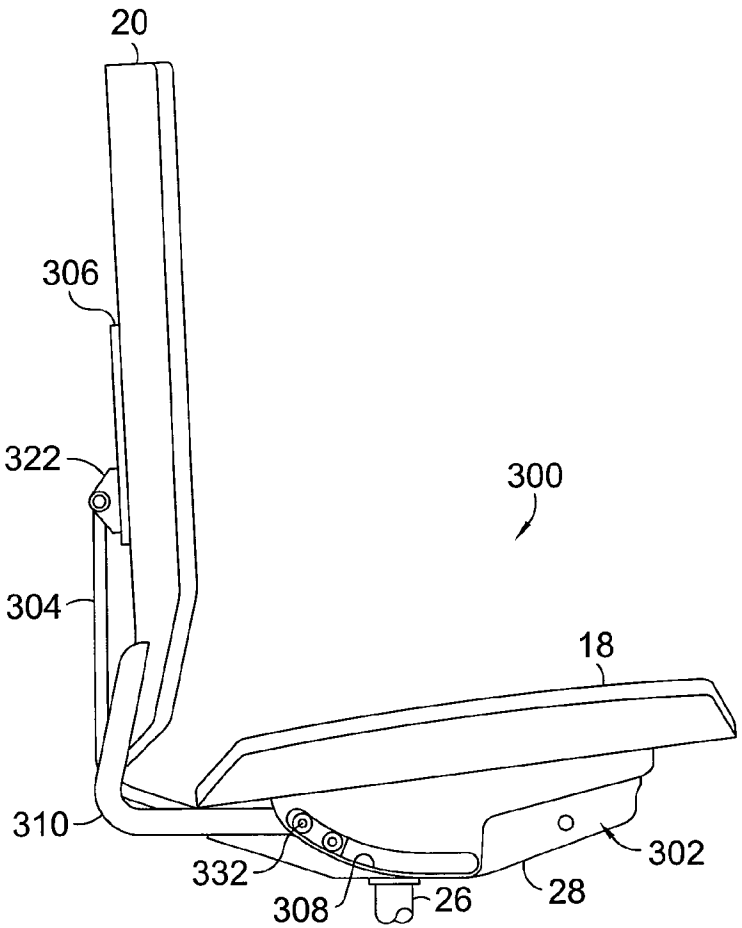
FIG. 10 is an enlarged side elevational view of the tilt mechanism of FIG. 9, showing the position of the mechanism components when the chair is in an upright position.

Turing to FIGS. 9-11, an embodiment of a tilt mechanism 300 is shown as integrated into the design of chair 10. Many components of the tilt mechanism 100 of FIGS. 1-8 are present in the embodiment of the tilt mechanism 300 illustrated in FIGS. 9-11, and therefore references to shared components between the embodiments will be abbreviated in the following discussion of the tilt mechanism 300.

Similar to the previous embodiment, the mechanism 300 includes a seat base 302 operatively supporting the chair seat 18, a back support bar 304 and a back bracket 306 interconnecting the chassis 28 with the chair back 20, as well as a corresponding number of guide track(s) 308 and back follower member(s) 310 working in tandem to tie movement of the chair back 20 with the seat base 302 and thus the chair seat 18. The seat base 302 is slidingly coupled to and supported by the chassis 28, enabling the seat base 302 to move linearly forwards and backwards proportionally and asynchronously with the tilting of the chair back 20. For instance, the mechanism 300 may employ coupling sliders (such as coupling sliders 118 of tilt mechanism 100) mounted onto the seat base 302 for engagement with chassis flanges, as with the previous embodiments. In one arrangement, the seat base 302 also slides upwardly when moving linearly forwardly relative to the chassis 28 (e.g., ramping at an angle of about 10 to 11 degrees above a horizontal plane).

The back support bar 304 has a proximal end 316 rigidly connected with the chassis body 30, a distal end 318, and a body portion 320 spanning between the two ends 316 and 318. A slider 322 at the distal end 318 of the back support bar 304 is pivotably connected with the body portion 320 thereof. The back bracket 306 has the same configuration as with previous embodiments (e.g., back brackets 106), thus enabling the chair back 20 coupled with the back bracket 306 to be pivotably and slidably coupled with the back support bar 304. The back bracket 306 is mounted directly to the chair back 20 at a position generally above where the back follower members 310 are mounted. Preferably, a pair of back follower members 310 are utilized, each being spaced from one another and mounted near lateral sides of the chair back. Each back follower member 310 is generally L-shaped, with a planar upper portion 326 abutting and rigidly attached to the chair back 20 and a lower portion 328 configured for moveable engagement with one of the guide tracks 308, as explained in further detail herein.

Each guide track 308 is formed into the seat base 302, and preferably into one of a pair of sidewalls 330 depending downwardly from opposed lateral sides of the base 302. In this configuration, each guide track 308 forms a slotted pathway in which a set of axially mounted rollers 332 travels in rolling engagement therewith. The rollers 332 are positioned to extend laterally outward from the back follower member lower portion 328 and are rotatably mounted therewith for positioning within the respective guide track 308. The guide tracks 308 preferably have a curvilinear shape to create the desired path of travel for the back follower members 310 and thus the chair back 20 upon the chair occupant leaning back to induce tilting of the back 20, as with the guide track 108 of the tilt mechanism 100 of FIGS. 1-8. Accordingly, the motion of each back follower member lower portion 328 relative to the respective guide track 308, and the motion of the slider 322 and connected back support bar 304 relative to the back bracket 306, facilitates the chair back 20 moving relative to both the chassis 28 and the seat base 302.

More specifically, upon entering the recline phase, the rollers 332 of each back follower member 310 move along the length of the respective guide track 308 to bring the back follower members 310 in a downward and forward curvilinear travel path in accordance with the virtual pivot point, as explained above with reference to the guide track 108 of the tilt mechanism 100 of FIGS. 1-8. Concomitant with this action, the leaning backward by the occupant also causes the back support bar 304 to flex and move rearwardly about the proximal end 316 thereof, while the back bracket 306 guides the generally downward movement of chair back 20 through the sliding connection with the slider 322 and the pinned connection of the slider 322 with the back support bar 304. Furthermore, the shifting of the occupant's upper body during the recline phase and the generally forwardly directed bias provided by the backward flexing of the back support bar 304 cause a reactive force that drives the forward sliding movement of the seat base 302 (and thus the seat 18) on the chassis 28 asynchronously and proportionally with the reclining of the seat back 20. All of these motions are reversed in the return phase as the user leans forwardly to the upright position.

It should be understood that the guide track 308 may be formed as a separate member or members attached to the seat base sidewalls 330, instead of being formed into the sidewalls 330, in a similar configuration to channel forming members 136 of the tilt mechanism 100 of FIGS. 1-8. However, as opposed to the tilt mechanism 100, the guide track 308 of the tilt mechanism 300 of FIGS. 9-11 designates a travel pathway for each back follower member lower portion 328 (at the attachment point of the rollers 332) that is generally below the seat 18. Additionally, it should be readily understood that the tilt mechanism 300 may include a single guide track 308 and back follower member 310, provided that such a configuration provides sufficient stability in movement of the chair back 20 between the reclined and the upright positions.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A tilt mechanism for use on a chair having a chassis, a seat, and a back, the mechanism comprising:

a seat base adapted to be slidably coupled to the chassis and configured for rigid coupling with the chair seat;

a back bracket configured for coupling with the chair back;

a back support bar having a body portion configured to extend from the chassis and a distal end configured for moveable engagement with the back bracket;

a guide track formed with at least one channel and being coupled with and extending rearwardly away from the seat base; and a back follower member configured for coupling with and depending downwardly from the chair back and received within the at least one channel of the guide track for moveable engagement therewith;

wherein movement of the chair from an upright position to a recline position such that the chair back moves rearwardly and downwardly relative to the chassis and achieves an increasing angle of tilt relative to the chair seat results in the back bracket moving relative to and in engagement with the back support bar distal end, the back follower member moving within the at least one channel of the guide track and the seat base sliding forwardly relative to the chassis.

2. The mechanism of claim 1, wherein the movement of the chair from an upright position to a recline position results in the back bracket moving relative to and in engagement with the back support bar distal end, the back follower member moving within the at least one channel of the guide track and the seat base sliding both forwardly and upwardly relative to the chassis.

3. The mechanism of claim 1, wherein the back bracket is formed with at least one linear slot, the distal end of the back support bar being configured for sliding engagement with the at least one linear slot.

4. The mechanism of claim 3, wherein the distal end of the back support bar is formed with a slider pivotably connected to the body portion, the slider being received within the at least one linear slot of the back bracket to slidably and pivotably couple the back support bar to the back bracket.

5. The mechanism of claim 1, wherein the back follower member is formed by a body portion and a set of rollers rotatably connected with the body portion for being in rolling engagement with the at least one channel of the guide track.

6. The mechanism of claim 1, wherein the guide track is formed by a pair of curvilinear opposed track members such that coordinated forward and upward sliding movement of the seat base and rearward and downward movement of the chair back creates a virtual pivot point.

7. The mechanism of claim 1, wherein the back bracket mounts upon the back follower member such that the back bracket couples with the chair back through the back follower member.

8. A chair, comprising a seat;

a back;

a seat base;

a support base assembly with an upwardly extending pedestal;

a chassis coupled to the pedestal; and a tilt mechanism coupling the seat, the seat base and the chassis, the mechanism including:

the seat base being slidably coupled to the chassis and rigidly coupled with the seat;

a back bracket coupled with the back;

a back support bar having a body portion extending from the chassis and a distal end moveably engaged with the back bracket;

a guide track formed with at least one channel and being coupled with and extending rearwardly away from the seat base; and a back follower member coupled with and depending downwardly from the chair back and received within the at least one channel of the guide track for moveable engagement therewith;

such that the configuration of the mechanism provides, upon movement of the chair from an upright position to a recline position whereby the chair back moves rearwardly and downwardly relative to the chassis and achieves an increasing angle of tilt relative to the seat, the back bracket moving relative to and in engagement with the back support bar distal end, the back follower member moving within the at least one channel of the guide track and the seat base sliding forwardly relative to the chassis.

9. The chair of claim 8, wherein the back bracket is formed with at least one linear slot, the distal end of the back support bar slidingly engaging with the at least one linear slot.

10. The chair of claim 9, wherein the distal end of the back support bar is formed with a slider pivotably connected to the body portion of the back support bar, the slider being received within the at least one linear slot of the back bracket to slidably and pivotably couple the back support bar to the back bracket.

11. The chair of claim 8, wherein the back follower member is formed by a body portion and a set of rollers rotatably connected with the body portion for being in rolling engagement with the at least one channel of the guide track.

12. The chair of claim 8, wherein the guide track is formed by a pair of curvilinear opposed track members such that coordinated forward and upward sliding movement of the seat base and rearward and downward movement of the chair back creates a virtual pivot point.

13. The chair of claim 8, wherein the back bracket mounts upon the back follower member such that the back bracket couples with the back through the back follower member.

* * * * *